US008509664B2

(12) United States Patent
Hasegawa et al.

(10) Patent No.: US 8,509,664 B2
(45) Date of Patent: Aug. 13, 2013

(54) IMAGE FORMING APPARATUS

(75) Inventors: Kenichi Hasegawa, Kanagawa (JP); Takeshi Yamamoto, Kanagawa (JP); Takashi Seto, Kanagaawa (JP); Fumihiro Hirose, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 322 days.

(21) Appl. No.: 12/959,705

(22) Filed: Dec. 3, 2010

(65) Prior Publication Data

US 2011/0182609 A1 Jul. 28, 2011

(30) Foreign Application Priority Data

Jan. 25, 2010 (JP) ..... 2010-013080

(51) Int. Cl.
*G03G 15/20* (2006.01)

(52) U.S. Cl.
USPC ..... 399/323

(58) Field of Classification Search
USPC ..... 399/94, 97, 323, 355
See application file for complete search history.

(56) References Cited

U.S. PATENT DOCUMENTS

| | | | | |
|---|---|---|---|---|
| 3,776,628 | A * | 12/1973 | Gundlach | 399/131 |
| 6,131,009 | A | 10/2000 | Hasegawa | |
| 6,496,666 | B2 | 12/2002 | Hayashi et al. | |
| 6,591,081 | B2 | 7/2003 | Hasegawa | |
| 7,070,182 | B2 | 7/2006 | Hasegawa | |
| 7,515,850 | B2 | 4/2009 | Hasegawa | |
| 7,551,882 | B2 | 6/2009 | Seto et al. | |
| 7,630,652 | B2 | 12/2009 | Hasegawa | |
| 7,643,767 | B2 | 1/2010 | Seto et al. | |
| 7,711,300 | B2 | 5/2010 | Nakafuji et al. | |
| 7,711,301 | B2 | 5/2010 | Takemoto et al. | |
| 7,790,343 | B2 | 9/2010 | Suzuki et al. | |
| 2006/0029411 | A1 | 2/2006 | Ishii et al. | |
| 2006/0218938 | A1 * | 10/2006 | Fornof | 62/3.4 |
| 2006/0257183 | A1 | 11/2006 | Ehara et al. | |
| 2007/0014600 | A1 | 1/2007 | Ishii et al. | |
| 2008/0199229 | A1 | 8/2008 | Fujita et al. | |
| 2008/0219717 | A1 | 9/2008 | Kayahara et al. | |
| 2008/0219718 | A1 | 9/2008 | Fujita et al. | |
| 2009/0003898 | A1 | 1/2009 | Kayahara et al. | |
| 2009/0016786 | A1 | 1/2009 | Suzuki et al. | |
| 2009/0116880 | A1 | 5/2009 | Takagaki et al. | |
| 2009/0297199 | A1 | 12/2009 | Yamashina et al. | |
| 2010/0014897 | A1 | 1/2010 | Seto et al. | |
| 2010/0014903 | A1 | 1/2010 | Seto et al. | |
| 2010/0092220 | A1 | 4/2010 | Hasegawa et al. | |

(Continued)

FOREIGN PATENT DOCUMENTS

| | | | |
|---|---|---|---|
| JP | 2002276842 | A * | 9/2002 |
| JP | 2008-102408 | | 5/2008 |

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

An image forming apparatus includes a compressed air generator, a nozzle, a tube, a cooling device, and a drain discharging portion. The compressed air generator generates and injects compressed air onto at least one of a recording medium and components in the image forming apparatus. The compressed air is injected from the nozzle. The tube connects the compressed air generator and the nozzle, and the compressed air passes through the tube. The cooling device cools at least a portion of the tube. The drain discharging portion discharges drain fluid generated in the tube during cooling by the cooling device.

14 Claims, 6 Drawing Sheets

(56) References Cited

U.S. PATENT DOCUMENTS

2010/0092221 A1 4/2010 Shinshi et al.
2010/0202809 A1 8/2010 Shinshi et al.
2010/0232844 A1 9/2010 Saito et al.
2010/0239292 A1 9/2010 Fujita et al.
2010/0290822 A1 11/2010 Hasegawa et al.

* cited by examiner

FIG. 5

TEMPERATURE

HUMIDITY

| | 10°C | 15°C | 20°C | 25°C | 30°C |
|---|---|---|---|---|---|
| 20% | 0.0 | 0.0 | 0.0 | 0.0 | 0.0 |
| 30% | 0.0 | 0.0 | 0.0 | 0.0 | 0.0 |
| 40% | 0.0 | 0.0 | 0.0 | 0.0 | 0.0 |
| 50% | 0.0 | 0.0 | 0.0 | 0.0 | 0.0 |
| 60% | 0.9 | 1.3 | 1.7 | 2.3 | 3.0 |
| 70% | 1.9 | 2.6 | 3.5 | 4.6 | 6.1 |
| 80% | 2.8 | 3.8 | 5.2 | 6.9 | 9.1 |

IMAGE FORMING APPARATUS

CROSS-REFERENCE TO RELATED APPLICATIONS

This patent application is based on and claims priority pursuant to 35 U.S.C. §119 from Japanese Patent Application No. 2010-013080, filed on Jan. 25, 2010 in the Japan Patent Office, which is hereby incorporated herein by reference in its entirety.

BACKGROUND OF THE INVENTION

1. Field of the Invention

Exemplary aspects of the present invention generally relate to an image forming apparatus, such as a copier, a facsimile machine, a printer, or a multi-functional system including a combination thereof.

2. Description of the Background Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image bearing member; an optical writer projects a light beam onto the charged surface of the image bearing member to form an electrostatic latent image on the image bearing member according to the image data; a developing device supplies toner to the electrostatic latent image formed on the image bearing member to make the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

There is widely known a fixing device that includes a fixing roller equipped with a halogen heater inside thereof and a pressure roller disposed opposite the fixing roller, thereby defining a fixing nip. The recording medium bearing the unfixed toner image is conveyed to the fixing nip where heat and pressure are applied thereto, and the unfixed toner image is fixed. This fixing method is known as a fixing method using a heat roller.

Another known fixing method is a belt fixing method, in which an endless-loop fixing belt is wound around and stretched between a heating roller equipped with a halogen heater inside thereof and a fixing roller pressed by a pressure roller through the fixing belt. The pressure roller and the fixing belt define a fixing nip in which heat and pressure are applied to the recording medium and the unfixed toner image thereon is fixed.

In either method, because the toner image fused on the recording medium contacts the fixing roller or the fixing belt, the fixing roller or the fixing belt is generally coated with fluorocarbon resin to facilitate separation of the recording medium from the fixing roller or the belt. In addition, a separation pawl is used to separate physically the recording medium from the fixing roller or the fixing belt. Disadvantageously, however, the known separation pawl contacts the fixing roller or the fixing belt and consequently the separation pawl may damage the surface of the roller or the belt. When this happens, an output image has undesirable streaks appearing therein.

To address such a problem, a generally-known monochrome image forming apparatus employs a fixing roller made of a metal roller coated with Teflon (registered trademark). In this configuration, the fixing roller is prevented from getting easily damaged even when the separation pawl contacts the fixing roller, thereby enhancing durability.

By contrast, in a case of a color image forming apparatus, the fixing roller has a surface layer made of silicone rubber (generally, a PFA tube with a thickness of some tens of microns is used) coated with fluoride, or applied with oil to enhance color development. In this configuration, the surface layer is relatively soft and hence can be damaged easily by the separation pawl. Accordingly, color image forming apparatuses in recent years hardly employ such a separation pawl that directly contacts the fixing belt to separate the recording medium therefrom, but instead employ a so-called contactless separation method.

Various contact-less separation methods have been proposed. For example, 1) a small gap (approximately 0.2~1.0 mm) is provided between the fixing roller/belt and a separation plate extending parallel to the fixing roller/belt, known as a contactless separation plate method. Or, 2) a small gap (approximately 0.2~1.0 mm) is provided between the fixing roller/belt and a plurality of separation pawls, which are disposed with a predetermined interval between each other, known as a contactless separation claw method. Alternatively, 3) the recording medium is separated from the fixing roller/belt using the resilience of the recording medium itself and the elasticity of a curved portion of the fixing roller/belt, known as a self-stripping method.

Common to all of the above-described approaches is a gap between a guide member for guiding the recording medium to the end of the fixing nip and the fixing roller/belt. When conveying a thin recording medium and/or a recording medium with little margin at the leading end thereof in the fixing nip, or when conveying a recording medium with an image such as a photograph, the recording medium tends to stick to the fixing roller/belt and remains adhered thereto, passing through the gap. As a result, the recording medium is rolled onto the fixing roller/belt, and/or paper jam occurs when the recording medium comes into contact with the separation plate or the separation pawl.

In view of the above, JP-2008-102408-A proposes blowing compressed air from a nozzle against an appropriate position for separating the recording medium from the fixing roller/belt.

Such a sheet separation mechanism includes an air pressure piping system to regulate the compressed air projected from a compressor to the nozzle. Using the compressed air, the recording medium is separated reliably from the fixing roller/belt without damaging the fixing roller/belt. Furthermore, this configuration is advantageous because the compressed air can be used to clean detection surfaces of detectors such as a temperature detector for detecting the temperature of the fixing member and a detector for detecting the presence of the recording medium by blowing the compressed air against these surfaces.

The related-art sheet separation device using the compressed air includes an air filter, an air tank, and a pressure adjusting valve, air pressure members such as an electromagnetic valve and a nozzle, and pipes connecting these parts, constituting the air pressure piping system. The air filter removes and transfers liquid droplets and foreign substance downstream of the compressor. The air tank reduces fluctuation of pressure of the compressed air. The pressure adjusting valve adjusts the pressure of the compressed air in the air tank. The air pressure members such as the electromagnetic valve and the nozzle control injection of the air.

Although advantageous, this configuration has a drawback. The air compressed by the compressor contains water. When the compressed air containing water is heated and cooled in the air pressure piping system, oversaturated water condenses into liquid droplets. In order to inject the compressed air into the atmosphere through the nozzle, the pressure of the compressed air in the air pressure piping system is reduced, causing adiabatic expansion and a decrease in the temperature.

This temperature drop generates liquid droplets, also known as drain fluid (hereinafter "drain"), in the air pressure pipes. If such drain accumulates in the air pressure pipes and the air is injected, the drain is injected from the nozzle, sticking to the fixing member and the recording medium, thus contaminating both the fixing member and the recording medium.

Furthermore, the drain in the air pressure pipes causes an operational problem and damage to the air pressure members such as the electromagnetic valve and the nozzle.

To address such a difficulty, a dehumidifier, also known as an air dryer, is provided downstream from the compressor in a device using a large compressor with an output of 1 kW or more. Various types of air dryer have been known. In one example of a known air dryer, moisture in high-temperature compressed air generated in the compressor is dehumidified by forced cooling , deliberately producing liquid droplets (drain). A water separator separates and discharges the drain outside the air pressure piping. Another method uses an absorbent material that absorbs moisture, or a hollow fiber filter that separates the moisture from the compressed air to discharge the moisture outside the air pressure piping.

Although advantageous, such known air dryers are generally expensive. Moreover, the air dryer using the air cooling method consumes relatively large amounts of power, and the air dryer using the hollow fiber filter requires high pressure of at least 0.2 MPa. By contrast, because generally-known image forming apparatuses only require a low pressure in a range of 0.05 to 0.2 MPa and a small flow rate to separate the recording medium from the fixing roller/belt, it is generally the case that the image forming apparatuses employ a small compressor with an output of 200 Watts or less, which does not adequately cool the moist air and produce drain before it arrives at the nozzles.

In view of the above, there is demand for a device capable of separating the recording medium with compressed air without contaminating the recording medium or other parts with drain.

SUMMARY OF THE INVENTION

In view of the foregoing, in one illustrative embodiment of the present invention, an image forming apparatus includes a compressed air generator, a nozzle, a tube, a cooling device, and a drain discharging portion. The compressed air generator generates and injects compressed air onto at least one of a recording medium and components in the image forming apparatus. The compressed air is injected from the nozzle. The tube, through which the compressed air passes, connects the compressed air generator and the nozzle. The cooling device cools at least a portion of the tube. The drain discharging portion discharges drain generated in the tube during cooling by the cooling device.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein:

FIG. 5 is a table showing amounts of drain at a pressure of 0.1 MPa;

DETAILED DESCRIPTION OF ILLUSTRATIVE EMBODIMENTS

Figure 1:
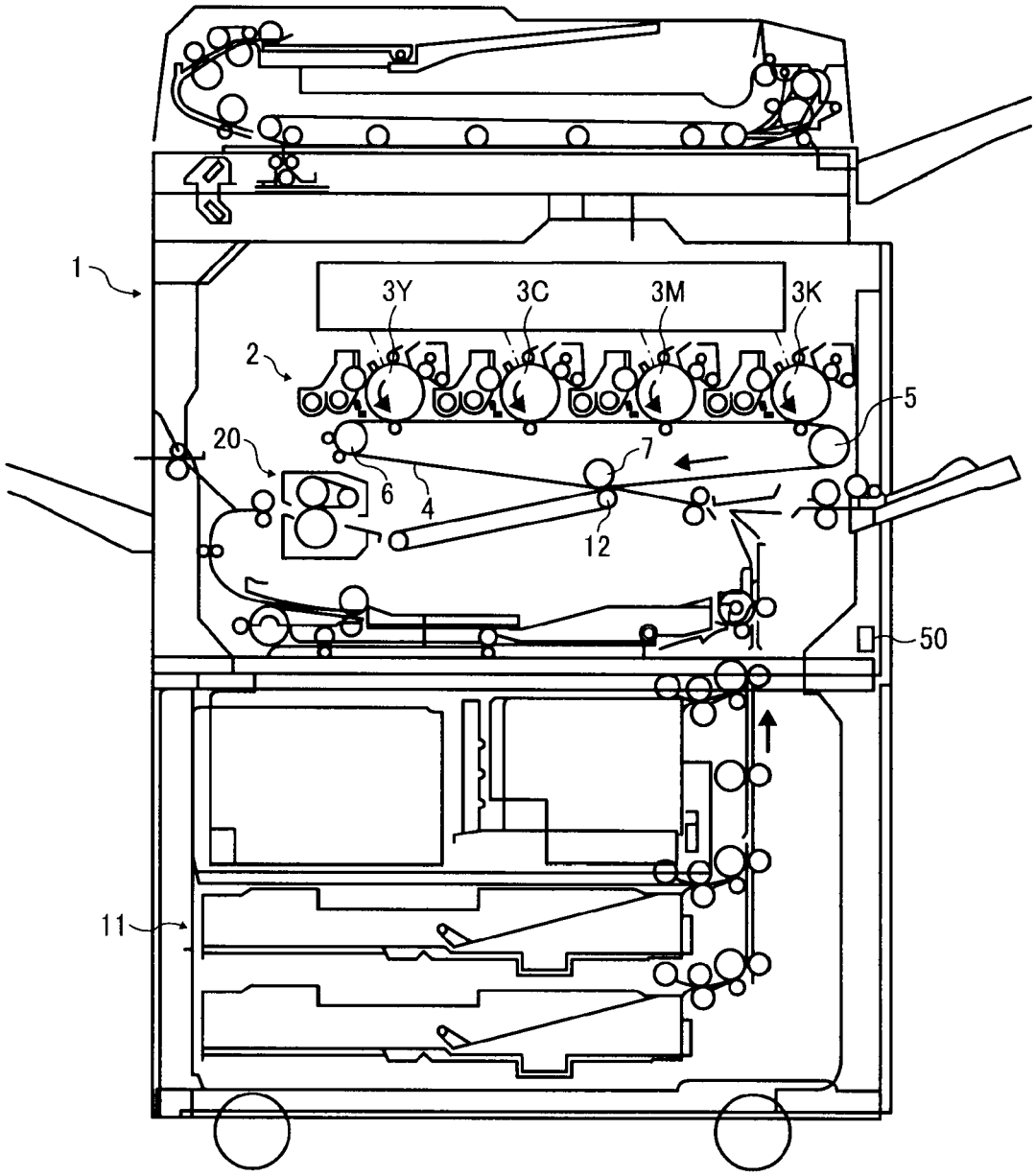
FIG. 1 is a schematic diagram illustrating an image forming apparatus according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

FIG. 1 is a schematic diagram illustrating a color image forming apparatus according to the illustrative embodiment. The image forming apparatus includes a main body 1 and a sheet feed unit 11 at the bottom of the main body 1. The main body 1 includes an image forming unit 2 and a fixing device 20.

As illustrated in FIG. 1, the image forming unit 2 includes image bearing members 3Y, 3C, 3M, and 3K, an intermediate transfer belt 4, and support rollers 5, 6, and 7. Toner images of yellow, cyan, magenta, and black are formed on the image bearing members 3Y, 3C, 3M, and 3K, respectively. The image bearing members 3Y, 3C, 3M, and 3K are drum-type photoreceptors. The intermediate transfer belt 4 is disposed facing the image bearing members 3Y, 3C, 3M, and 3K, and wound around and stretched between the support rollers 5, 6, and 7. The intermediate transfer belt 4 rotates in the clockwise direction indicated by an arrow in FIG. 1.

According to the illustrative embodiment, the image forming apparatus includes a plurality of print modes including a full-color print mode and a monochrome print mode, for example. When the full-color mode is selected, the image bearing member 3Y rotates in a counterclockwise direction while being charged to a predetermined polarity by a charging device. The charged surface of the image bearing member 3Y is illuminated with an optically-modulated laser beam projected from an optical writer, thereby forming an electrostatic latent image on the surface thereof. Subsequently, the electrostatic latent image on the image bearing member 3Y is developed with yellow toner, thereby forming a visible image, also known as a toner image.

A primary transfer roller is disposed opposite the image bearing member 3Y through the intermediate transfer belt 4. By applying a transfer voltage to the primary transfer roller, the toner image on the image bearing member 3Y is primarily transferred onto the intermediate transfer belt 4 moving in a direction of arrow in FIG. 1.

After the toner image is transferred from the image bearing member 3Y onto the intermediate transfer belt, the residual toner remaining on the image bearing member 3Y is removed by a cleaning device. Similar to the image bearing member 3Y, toner images of cyan, magenta, and black are formed on the image bearing members 3C, 3M, and 3K, respectively. The toner images of cyan, magenta, and black are sequentially and overlappingly transferred onto the yellow toner image on the intermediate transfer belt 4, thereby forming a composite or full-color toner image on the intermediate transfer belt 4.

With reference to FIG. 1, a description is now provided of a sheet feeding mechanism. As illustrated in FIG. 1, the sheet feed unit 11 is disposed substantially below the main body 1. The sheet feed unit 11 includes a sheet cassette storing a recording medium P such as a recording medium, and a sheet feed roller. When the sheet feed roller rotates, a top sheet of the recording medium P is sent in the direction of arrow in FIG. 1.

The recording medium P being conveyed is stopped temporarily by a pair of registration rollers. The pair of registration rollers feed the recording medium P between the intermediate transfer belt 4 wound around the support roller 7 and a secondary transfer roller 12 at a certain timing. At this time, the secondary transfer roller 12 is applied with a predetermined transfer voltage, thereby transferring secondarily the composite toner image from the intermediate transfer belt 4 onto the recording medium P.

The recording medium P onto which the composite toner image is transferred is conveyed to the fixing device 20 in which the toner image on the recording medium P is fixed thereon by heat and pressure. Subsequently, the recording medium passes through the fixing device 20 and is discharged outside the main body 1.

Figure 2:
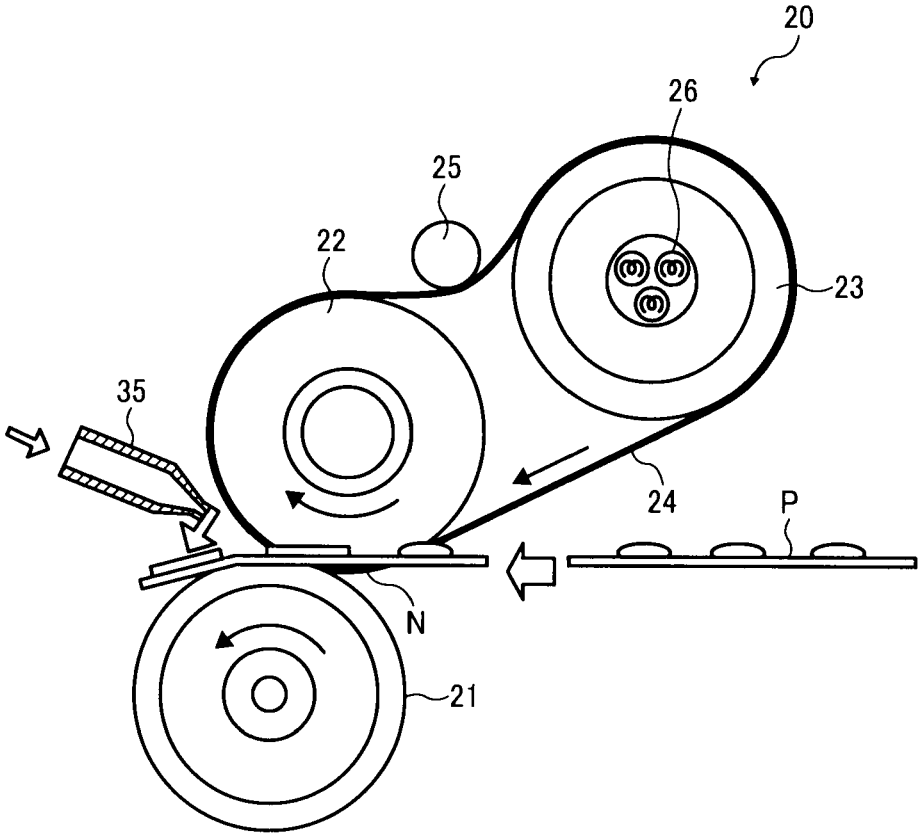
FIG. 2 is a schematic diagram illustrating a fixing device employed in the image forming apparatus of FIG. 1.

With reference to FIG. 2, a description is now provided of the fixing device 20. FIG. 2 is a schematic diagram illustrating the fixing device 20. The fixing device 20 includes a pressure roller 21, a fixing roller 22, a heating roller 23, and a fixing belt 24. The pressure roller 21 serves as a pressing member. The fixing roller 22 serves as a fixing member. The fixing belt 24 is an endless looped belt wound around and stretched between the fixing roller 22 and the heating roller 23.

The fixing belt 24 is formed of a base layer, a silicon rubber layer, and a layer of tetrafluoroethylene-perfluoroalkylvinylether copolymer (PFA). The silicon rubber layer is provided on the base layer. The PFA layer, which is an outer circumferential surface layer provided on the silicon rubber layer, has good separability.

The fixing roller 22 includes a metal core on which a heat-resistant elastic layer such as foam silicon rubber or the like is formed. The heating roller 23 is formed of a hollow aluminum cylinder.

The pressure roller 21 includes a hollow steel cylinder covered with a silicon rubber layer. On the silicon rubber layer, a PFA tube is provided as an outer circumferential surface. The surface hardness of the pressure roller 21 is greater than that of the fixing roller 22. That is, the surface of the pressure roller 21 is harder than the fixing roller 22. In this configuration, the fixing roller 21 engages the fixing roller 22 through the fixing belt 24, thereby defining a nip N and deforming the elastic layer of the fixing roller 22 in accordance with the outer shape of the pressure roller 21.

It is to be noted that the fixing device 20 of the illustrative embodiment selectively includes a tension roller 25 to exert tension on the fixing belt 24. The tension roller 25 may be disposed in the inner loop of the fixing belt 24 or outside of the loop.

Inside the heating roller 23, a heating member 26 is provided. The heating member 26 may be a halogen heater or a carbon heater, but is not limited thereto. The heating member 26 may employ a heat source using electromagnetic induction. Alternatively, the heating member 26 may be provided inside the pressure roller 23.

Power is supplied to the heating member 26 based on the temperature of the surface of the fixing belt 24 detected by a detector, not illustrated, disposed opposite the heating roller 23 in the vicinity of the fixing belt 24, for example.

In the fixing device 20, the fixing belt 24 is rotated in the clockwise direction by rotating the fixing roller 22 in the clockwise direction by a driving device. Rotation of the fixing belt 24 causes the heating roller 23 and the pressure roller 21 to rotate.

It is to be noted that the fixing belt 24 of the fixing device 20 according to the illustrative embodiment is supported by two rollers, that is, the fixing roller 22 and the heating roller 23. However, the number of rollers is not limited to two, and the number of rollers may be determined arbitrarily. Furthermore, instead of using the pressure roller 21 as a pressing member, a pressure belt wound around a plurality of rollers may be used. The fixing device 20 may be a roller-type fixing device using a fixing roller and a pressure roller.

According to the illustrative embodiment, in order to prevent the recording medium P passed through the nip N from sticking to the fixing belt 24 in the fixing device 20, the image forming apparatus includes a sheet separation device using compressed air. A description thereof is provided with reference to FIG. 3 as follows.

Figure 3:
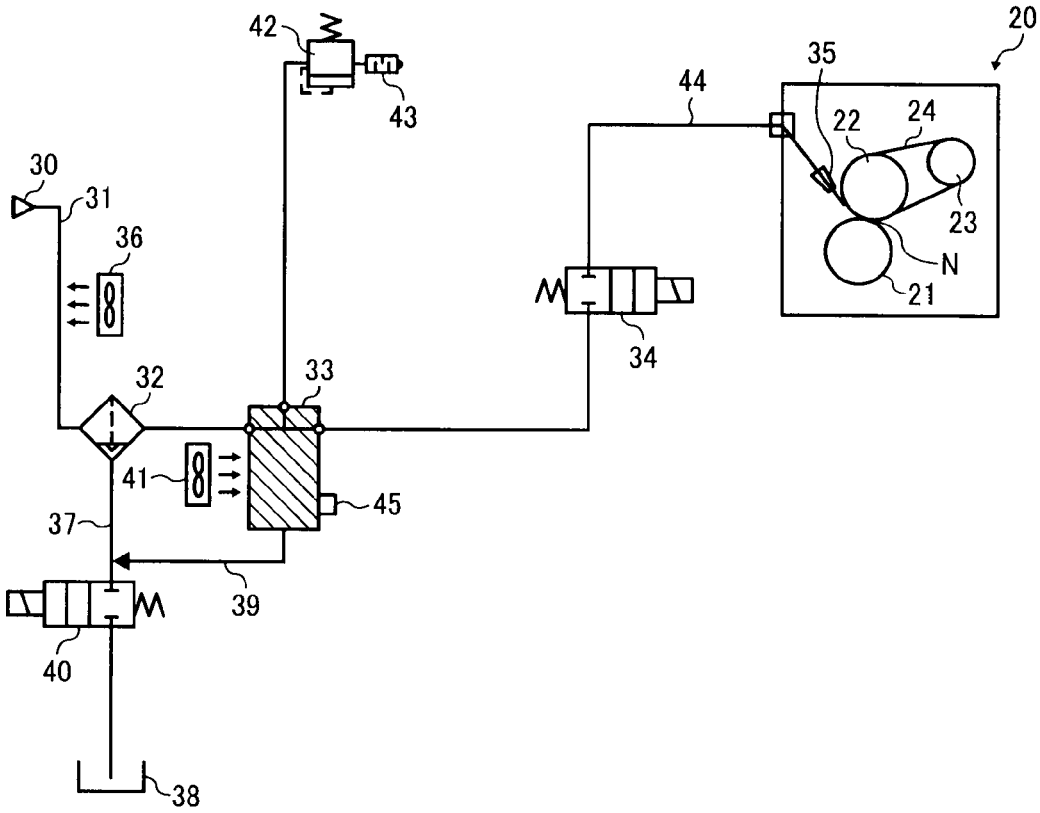
FIG. 3 is a piping diagram of a sheet separation device employed in the image forming apparatus, depicted in accordance with JIS B 0125.

Referring now to FIG. 3, a description is now provided of a sheet separation device according to the illustrative embodiment. FIG. 3 is a circuit diagram illustrating an air pressure piping system of the sheet separation device. A portion of the air pressure piping configuration except the fixing device 20 is depicted in accordance with JIS B 0125.

As illustrated in FIG. 3, the sheet separation device includes a compressor 30 that generates compressed air. The compressor 30 is a relatively small compressor (output: 100 W) of a reciprocating compressor type and can compress air up to 0.4 MPa. The compressor 30 does not include a designated pressure adjustment mechanism, but the pressure is adjusted downstream by air pressure piping . In the compressor 30, as the pressure of the downstream air piping increases, the flow rate (L/min) decreases. The compressor 30 does not start unless the pressure in the downstream air pressure piping corresponds to atmospheric pressure (0 MPa). A filter, not illustrated, is provided at an air intake port of the compressor 30 to prevent foreign substances from getting into the compressed air.

Now, with reference to FIG. 3, description is provided of flow of the compressed air in the sheet separation device according to the illustrative embodiment. The compressed air generated by the compressor 30 is guided to an air filter 32 through a tube 31. The air filter 32 removes foreign substance in the compressed air.

After passing through the air filter 32, the compressed air is stored in an air tank 33. Subsequently, the compressed air is guided to a nozzle 35 (see FIG. 2) through an electromagnetic nozzle 34 which controls ON and OFF of injection of the compressed air, thereby injecting the compressed air against the leading end of the recording medium P passed through the nip portion.

With this configuration, the recording medium P is separated from the fixing belt 24 without contacting the recording medium P. It is to be noted that the air pressure pipes such as the tube 31 or the like are commonly hollow flexible tubes, metal tubes, and so forth. The material for the hollow flexible tube includes, but is not limited to, polyurethane, nylon, and fluorocarbon resin.

The air tank 33 serves as a buffer for injection of the compressed air. Storing the compressed air in the air tank 33 enables injection of air at stable pressure. If the volume of the air tank 33 is too large, it takes time to raise the pressure to a desirable pressure. Therefore, it is preferable that the volume of the air tank 33 have a minimum volume for achieving a stable injection of air, for example, approximately 1 L or the like.

Alternatively, depending on the configuration of the nozzle and injection, the air tank 33 may be eliminated. Furthermore, when increasing the size of the air filter 32, the air filter 32 may be used as a substitute for the air tank 33.

Since the air tank 33 is subjected to high pressure, the air tank 33 is made of metal having a relatively high stiffness. In the event of abnormal operation, the air tank 33 is configured to withstand at least the maximum pressure of the compressor 30. According to the illustrative embodiment, the air tank 33 is made of a welded steel plate having a thickness of approximately 5 mm, for example.

The air tank 33 includes a pressure adjustment valve (relief valve) 42. The pressure adjustment valve 42 adjusts the pressure in the air tank 33 at a certain pressure by discharging the compressed air in the air tank 33. The pressure adjustment valve 42 uses a screw to adjust the pressure. When the compressor 33 is activated, the screw of the pressure adjustment valve 42 is adjusted to achieve a desirable pressure in the air tank. After adjustment, the screw is fixed.

According to the illustrative embodiment, the pressure of the air tank 33 is adjusted at 0.1 MPa during operation of the compressor 30. A silencer 43 is provided to reduce noise when the compressed air is discharged through the pressure adjustment valve 42.

The air tank 33 is connected to the nozzle 35 through a tube 44 and the electromagnetic valve 34. A plurality of nozzles 35 is provided with a certain distance therebetween to inject the compressed air onto the front end portion of the recording medium P passed through the nip portion N.

The electromagnetic valve 34 is a two-port valve. When the power is off, the piping is closed. By contrast, when the power is on, the piping is opened. When the electromagnetic valve 34 is activated, the compressed air in the air tank 33 adjusted by the pressure adjustment valve 42 is injected from the nozzles 35.

Before the recording medium P passes through the nip N, the electromagnetic valve 34 is activated and starts injecting the compressed air. After the recording medium P is separated, the electromagnetic valve 34 is deactivated, thereby stopping injection. According to the present illustrative embodiment, the compressed air is injected for 100 ms per injection to separate the recording medium P from the fixing belt 24 contactlessly.

As described above, the temperature of the compressed air generated in the compressor 30 is relatively high. However, when it is cooled, drain is generated. If the drain arrives at the nozzle 35 and is injected, the recording medium P and the fixing belt 24 may be contaminated.

If the hot compressed air generated in the compressor 30 is cooled as the compressed air passes through the tube 31 and the drain generated in the tube 31 is discharged before the drain reaches the nozzle 35, the recording medium P and the fixing belt 24 may be prevented from getting contaminated.

Figure 4:
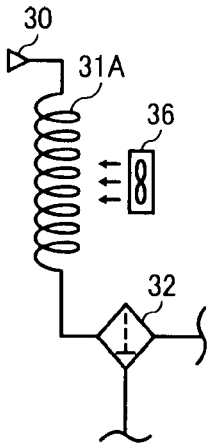
FIG. 4 is a schematic diagram illustrating a variation of a tube employed in the sheet separation device.

In view of the above, one conceivable solution is extension of the length of the tube 31 as illustrated in FIG. 4. FIG. 4 is a schematic diagram illustrating a variation of the tube. For example, as illustrated in FIG. 4, employing a coil tube 31A can save space while achieving extension of the tube 31. Furthermore, instead of using the tube 31, a metal tube having good heat conduction may be used. Although not illustrated, a heat-release fin may be added to the metal tube to cool it more effectively.

Although advantageous, the hot compressed air may not be cooled adequately in this configuration. In other words, the drain may not be generated adequately in the tube 31, thereby preventing the drain from being discharged before the drain reaches the nozzle 35.

According to the present illustrative embodiment, a first fan 36 serving as a cooling device is provided in the vicinity of the tube 31 to forcibly cool the tube 31. In this configuration, the air flow generated by the fan 36 can cool the tube 31, condensing water vapor into liquid droplets, the drain. Using a fan as a cooling device such as in the first fan 36 costs relatively low and consumes less energy. However, the fan has low cooling efficiency and produces relatively large noise.

In view of the above, instead of using the first fan 36 as a cooling device, a cooling device using a known Peltier mechanism may be used. The Peltier cooling device is a cooling device using the Peltier effect and is used in many different fields. When employing the Peltier cooling device, the Peltier cooling device contacts the tube 31 directly so that the cooling efficiency is higher than the cooling device using the fan, and moreover it does not produce noise.

Although the Peltier cooling device has relatively high cooling efficiency and produces less noise compared with the fan, both power consumption and cost are relatively high, and the Peltier cooling device itself emits heat.

As described above, when the tube is cooled, the drain is generated in the tube 31. In order to prevent the drain from flowing back to the compressor 30 when operation is stopped, it is preferable to dispose the tube 31 downward from the compressor 30 and/or provide a check valve in the tube 31.

In order to accumulate the drain generated in the tube 31 in the air filter 32 and discharge out of the piping system, the air filter 32 is provided with a drain port 37 serving as a drain discharging portion equipped with an electromagnetic valve 40.

The electromagnetic valve 40 releases pressure in the piping and discharges the drain. When the operation of the image forming apparatus is stopped, the electromagnetic valve 40 is configured to open so that the pressure in the piping system is released. In the meantime, the drain accumulated in the air filter 32 is discharged. The discharged drain drops on a vaporizing plate 38 on which the drain is vaporized naturally.

A device to accumulate (capture) the drain includes a water separator, for example. The water extraction ratio of the water separator is approximately 99%. However, the water separator does not remove foreign substance such as dust in the compressed air, compared with the air filter 32.

The air tank 33 is made of metal and the contact area thereof with the compressed air is relatively large. Therefore, the compressed air is easily cooled. If the water vapor is not adequately cooled and condensed into liquid droplets (drain) in the piping upstream from the air tank 33, the water vapor becomes drain in the air tank 33 and sticks to the wall of the air tank 33. As a result, the drain accumulates at the bottom of the air tank 33.

In view of the above, a drain port 39 is provided at the bottom of the air tank 33 and connected to the drain port 37 described above. The drain port 39 is connected to the electromagnetic valve 40 via the drain port 37. In accordance with operation of the electromagnetic valve 40, in particular, when the operation of the image forming apparatus is stopped, the pressure and the drain are released by the electromagnetic valve 40.

In order to facilitate condensation of water vapor into liquid droplets (drain) in the air tank 33, a second fan 41 serving as a cooling device is provided in the vicinity of the air tank 33. By activating the second fan 41, the air tank 33 is forcibly cooled. Similar to the first fan 36, the second fan 41 cools down the air tank 33 using the air flow at low cost and consumes less power. However, the second fan 41 also produces noise and has low cooling efficiency.

Instead of using the second fan 41 as a cooling device, a cooling device using a Peltier mechanism may be used. As described above, the Peltier cooling device is a cooling device using the Peltier effect used in many different fields. When employing the Peltier cooling device, the Peltier cooling device is disposed to contact the air tank 33 so that the cooling efficiency is higher than the fan and does not produce noise.

Also as described above, although the Peltier cooling device has relatively high cooling efficiency and produces no noise compared with the fan, both power consumption and cost are relatively high, and the Peltier cooling device itself emits heat.

According to the illustrative embodiment, the drain is deliberately produced in the tubes and discharged before the drain reaches the nozzle 35. With this configuration, the recording medium P and the fixing belt 24 are reliably prevented from getting contaminated by the drain.

When the electromagnetic valve 34 is activated, the compressed air in the air tank 33, and in the tube 44 connecting the air tank 33 and the electromagnetic valve 34 adiabatically expands and is cooled, thereby generating the drain. However, since the water vapor is condensed into liquid droplets or so-called drain before the drain arrives at the air tank 33, the amount of drain to be generated in the tube 44 is very small, and thus the drain discharged from the nozzle 35 and adhered to the recording medium and the fixing belt 24 for each injection is insignificant.

A description is now provided of calculation of an amount of drain when air having a temperature t (° C.) and a humidity h (%) is compressed to a pressure P (MPa) and the temperature thereof changes. The humidity herein refers to a relative humidity. The pressure refers to a gauge pressure.

First, an amount of saturated water vapor Wt ($g/m^3$) at a temperature t (° C.) is obtained from a saturated water vapor table, not illustrated.

Next, an amount of water vapor content W1 ($g/m^3$) at the temperature t (° C.) and the humidity h (%) is obtained by the following equation:

$$W1=Wt\times(h/100)$$

Subsequently, the amount of saturated water vapor W2 ($g/m^3$) at the pressure P (MPa) and the temperature t (° C.) is obtained by the following equation:

$$W2=W1\times[0.1/(P+0.1)]$$

Lastly, the amount of drain Wp ($g/m^3$) to be generated is obtained by Wp=W1−W2. If Wp=0, that is, if the amount of drain is 0, W1 equals W2 (W1=W2), and hs=10/(P+0.1), where hs is a humidity at which the drain starts to generate and determined by the pressure.

When P=0.1 MPa, the humidity at which the drain starts generating is 50%. When P=0.2 MPa, the humidity at which the drain starts generating is 33%. Lower pressure is advantageous in terms of generation of the drain.

With reference to FIG. 5, a description is provided of generation of the drain ($g/m^3$) when the pressure P is 0.1 MPa. FIG. 5 is a table showing an amount of drain ($g/m^3$) at the pressure P=0.1 MPa.

The drain is generated when the air compressed in the compressor is cooled to the room temperature in the air pressure piping and the humidity is 50% or more. When the humidity is 50% or more, the amount of drain ($g/m^3$) increases proportionately with an increase in the humidity and the temperature.

As can be understood from FIG. 5, generation of drain depends largely on the humidity and the temperature. In particular, the drain is most likely generated at high temperature and high humidity.

Figure 6:
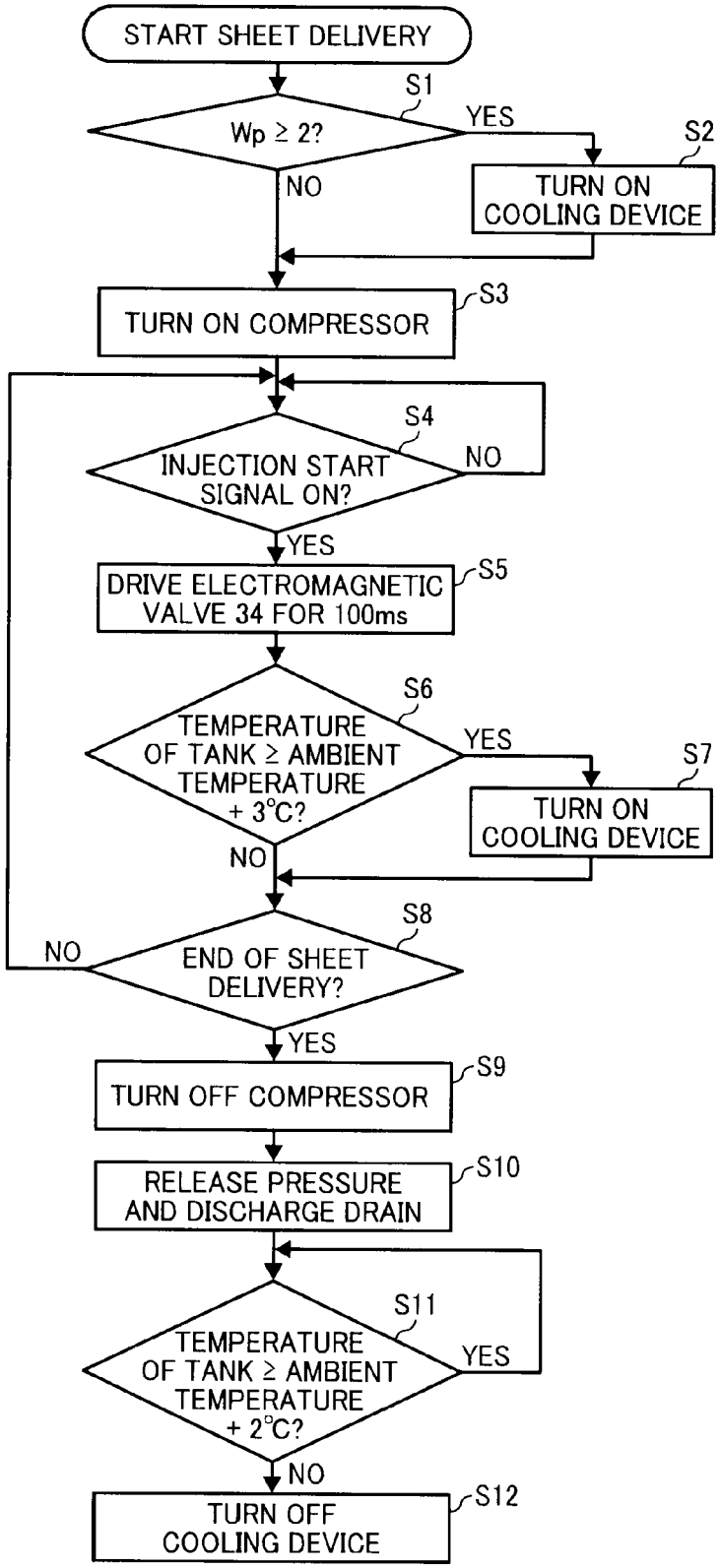
FIG. 6 is a flowchart showing steps in a sheet separation process of the sheet separation device according to an illustrative embodiment of the present invention.

The operation of the sheet separation device using the compressed air is now explained with reference to FIG. 6. FIG. 6 is a flowchart showing steps in a sheet separation process of the sheet separation device using the compressed air.

In FIG. 6, when conveyance of the recording medium is initiated, a temperature/humidity detector 50 (see FIG. 1) disposed in the image forming apparatus detects the ambient temperature and the humidity. The temperature/humidity detector 50 may be disposed in the image forming apparatus where the temperature/humidity detector 50 is less affected by heat and humidity inside the apparatus. In FIG. 1, a temperature detector and a humidity detector constitute a single integrated unit as the temperature/humidity detector 50. Alternatively, however, the temperature detector and the humidity detector may be provided separately.

The amount of drain Wp ($g/m^3$) generated is obtained from the table in FIG. 5 prestored in the image forming apparatus. Whether or not the value Wp ($g/m^3$) is equal to or greater than 2 is determined at step S1. When Wp is less than 2, it is assumed that the recording medium P and the fixing belt 24 are not adversely affected, and thus the first fan 36 and the second fan 41 are not activated.

By contrast, when Wp is equal to or greater than 2, the first fan 36 and the second fan 41 are activated at step S2 and the compressor 30 is operated at step S3.

With this configuration, when the drain does not adversely affect the recording medium P and the fixing belt 24, the cooling devices such as the first fan 36 and the second fan 41 are not operated, thereby reducing power consumption and noise.

According to the illustrative embodiment, whether or not Wp is equal to or greater than 2 determines activation of the first fan 36 and the second fan 41 serving as the cooling devices. The value of Wp serving as a reference value may be other than 2. The activation of the cooling devices may be determined based either on the humidity or the temperature, or both. Humidity is particularly important for it is closely associated with start of generation of the drain.

If the humidity detector is not provided, the temperature detector alone can determine operation of the cooling devices, because there is a correlation between the temperature and the humidity. More particularly, when the temperature is generally high, the humidity tends to be high. When the temperature is generally low, the humidity tends to be low.

According to the illustrative embodiment, the first fan 36 and the second fan 41 are activated at the same time when Wp is equal to or grater than 2. Alternatively, the first fan 36 and the second fan 41 may be activated separately with different values of Wp. Accordingly, more fine adjustment of cooling may be performed.

After the compressor is operated, the pressure of the air tank 33 increases. When reaching 0.1 MPa, the pressure of the air tank 33 is adjusted to maintain 0.1 MPa by the pressure adjustment valve. Before the first sheet of the recording medium arrives at the fixing device, the pressure of the air tank 33 is configured to reach 0.1 MPa. When the recording medium arrives substantially in the vicinity of the fixing device, the leading end of the recording medium is detected by a sheet detector, not illustrated, and an air injection start signal is transmitted from a controller at a certain timing at step S4.

When the injection start signal is transmitted, the electromagnetic valve 34 is driven for about 100 ms at step S5, enabling injection of the compressed air from the nozzle 35 against the leading end of the recording medium to separate the recording medium from the fixing belt 24.

A thermistor 45 is provided to the air tank 33 to detect the temperature of the air tank 33. If the detected temperature of the air tank 33 is at least 3° C. higher than the ambient temperature at step S6, the cooling devices are activated at step S7.

When continuously conveying the recording medium, the high-temperature compressed air generated by the compressor 30 runs through the air pressure piping system, causing the temperature of the tubes to increase, thus reducing the amount of drain produced by cooling. If only a small amount of drain is produced in the compressed air, the compressed air is not adequately dehumidified. In such a case, adiabatic expansion between the air tank 33 and the electromagnetic valve 34 generates the drain undesirably which is then injected from the nozzles 35.

To address such a difficulty, according to the illustrative embodiment, the temperature of the air tank 33 is adjusted to prevent the temperature of the tubes from rising. Accordingly, the drain is prevented from being injected from the nozzles 35. The electromagnetic valve 34 remains in operation while the temperature of the air tank 33 is detected until conveyance of the recording medium is finished at step S8.

After conveyance of the recording medium is finished, at step S9, the compressor 30 is stopped. Subsequently, at step S10, by activating the electromagnetic valve 40, pressure in the air filter 32 and the air tank 33 is released, and the drain is discharged out of the tubes.

Reducing the pressure in the air pressure tubes to the atmospheric pressure prepares the compressor 30 for the subsequent operation. Even after conveyance of the recording medium is finished, detection of the temperature of the air tank 33 continues, and the cooling devices operate until the temperature of the air tank 33 drops to the room temperature or the temperature not more than the room temperature +2° C. at step S11. When the temperature of the air tank 33 reaches the desirable temperature, the cooling devices are stopped at step S12.

With this configuration, even when the temperature of the air tank 33 rises after a long operation, the temperature of the air pressure tubes is cooled down to a room temperature or substantially near the room temperature before the subsequent operation starts. Further, by forcibly cooling the air pressure tubes in the environment in which the drain may be easily generated, the drain generated in the tubes can be separated reliably, and the amount of the drain generated by adiabatic expansion between the air tank 33 and the electromagnetic valve 34 is small. Accordingly, the drain is prevented from being injected from the nozzle 35.

Furthermore, according to the illustrative embodiment, advantageously, the cooling devices are only driven when necessary as described above so that power consumption and noise are reduced.

Figure 7:
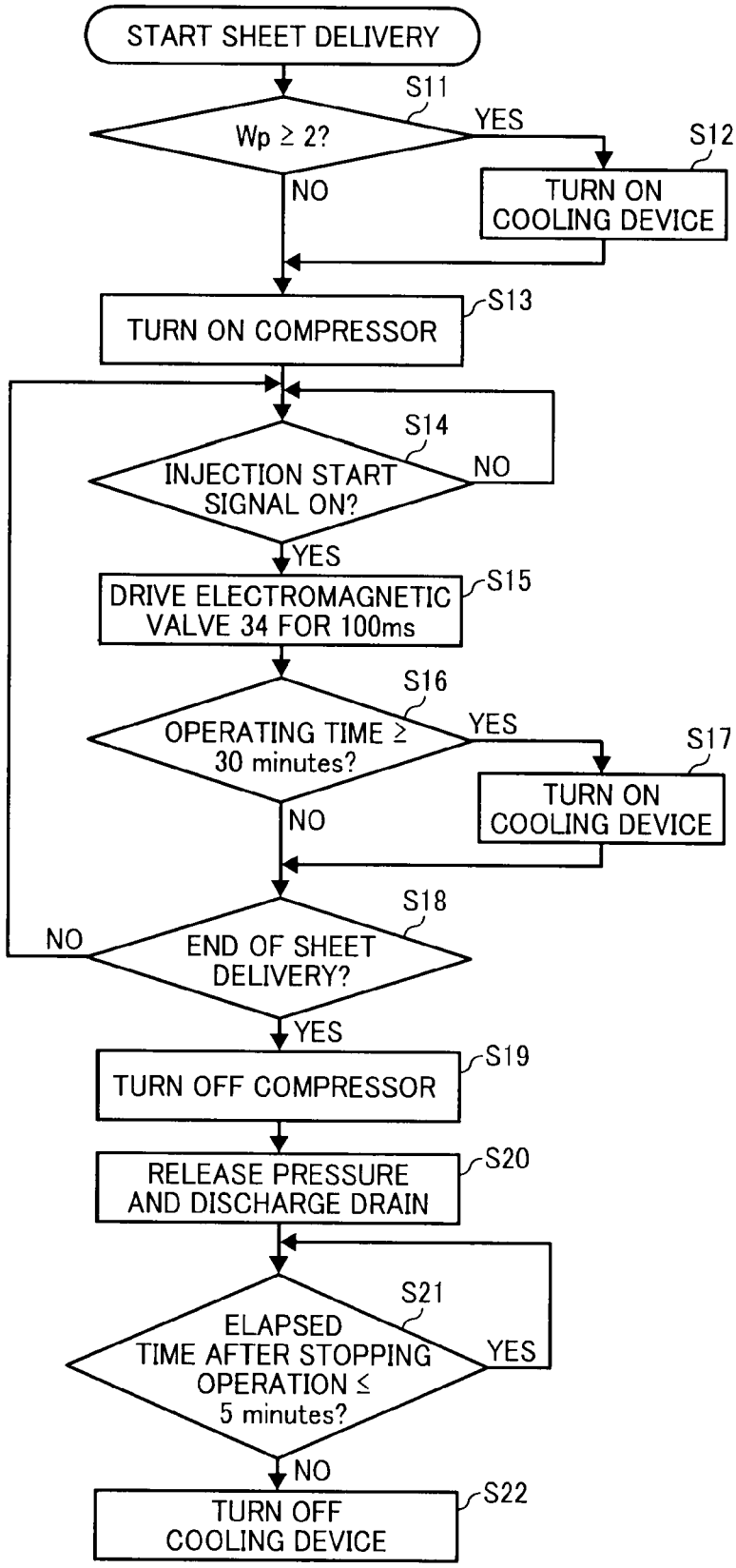
FIG. 7 is a flowchart showing steps in a sheet separation process of the sheet separation device according to another illustrative embodiment of the present invention.

Referring now to FIG. 7, a description is now provided of the sheet separation process according to another illustrative embodiment. FIG. 7 is a flowchart showing steps in the sheet separation process using the compressed air according to another illustrative embodiment of the present invention. It is to be noted that steps S11 through S15 are similar to the steps S1 through S5 in FIG. 6. Thus, the description thereof is omitted.

According to the present embodiment, at step S16, the operation time (conveyance time of the recording medium) of the image forming apparatus is determined during conveyance of the recording medium. When the operation time of the image forming apparatus is equal to or greater than 30 minutes, it is assumed that the temperature of the air pressure tubes has risen, and the cooling devices are activated at step S17.

The activation timing of the cooling devices is determined in advance based on an experiment in which the temperature rise of the air pressure tubes is measured. Alternatively, the total number of sheets being conveyed may determine the activation timing of the cooling devices, because the total number of sheets being conveyed is associated with the operation time of the image forming apparatus.

Further, the operation time of the compressor may be used determine the activation timing of the cooling devices. The parameters for the activation timing of the cooling devices are not limited to the above. The activation timing of the cooling devices may be determined by parameters that relate to the operation time of the image forming apparatus such as the number of operation of the electromagnetic valve.

When conveyance of the recording medium is finished at step S18, the compressor 30 is stopped at step S19. Subsequently, at step S20, the electromagnetic valve 40 is operated, thereby releasing the pressure and the drain from the air filter 32 and the air tank 33 out of the tubes.

Reducing the pressure in the air pressure tubes to the atmospheric pressure prepares the compressor 30 for the subsequent operation. Even after conveyance of the recording medium is finished, the cooling devices operate for approximately 5 minutes at step S11 and stops at step S12, thereby cooling the air pressure tubes in preparation for the subsequent operation.

The time for cooling is not limited to 5 minutes. The time for cooling may be determined according to the operation time. For example, if the operation time is not long, the cooling operation does not need to be performed after conveyance of the recording medium is finished.

Continuous operation of the image forming apparatus heats the air pressure tubes, thereby preventing deliberate generation of drain in the tubes. Consequently, adiabatic expansion in the area between the air tank 33 and the magnetic valve 34 increases generation of drain which is then injected from the nozzle 35. However, according to the illustrative embodiment, the air pressure tubes are forcibly cooled based on the operation time and/or the temperature of the air pressure tubes, thereby reducing, if not preventing entirely, generation of the drain due to adiabatic expansion between the air tank 33 and the electromagnetic valve 40. In this configuration, the drain is prevented from being injected from the nozzles 35.

Furthermore, in this configuration, the cooling devices are operated when necessary as described above so that the power consumption and noise are reduced.

According to the illustrative embodiments, the sheet separation device using the compressed air does not contaminate the recording medium and the image forming apparatus with drain.

Alternatively, a known contactless separation claw or a separation plate may be employed in addition to the sheet separate device using the compressed air to achieve even more reliable sheet separation. In this configuration, even when the pressure of the compressed air happens to decrease to some extent, the recording medium can still be separated with the separation claw or the separation plate.

Furthermore, injection of the compressed air may be used to clean the detection surface of the contactless detectors for detection of the temperature of the fixing device, the presence of the recording medium in the sheet conveyance path, and so forth without contaminating the surface of the detector by the drain.

According to the illustrative embodiment, the present invention is employed in the image forming apparatus. The image forming apparatus includes, but is not limited to, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a compressed air generator to generate and inject compressed air onto at least one of a recording medium and components in the image forming apparatus;

a nozzle from which the compressed air is injected;

a tube to connect the compressed air generator and the nozzle, through which the compressed air passes;

a cooling device to cool at least a portion of the tube; and a drain discharging portion to discharge drain fluid generated in the tube during cooling by the cooling device in response to the recording medium completing a conveyance in the image forming apparatus.

2. An image forming apparatus, comprising:

a compressed air generator to generate and inject compressed air onto at least one of a recording medium and components in the image forming apparatus;

a nozzle from which the compressed air is injected;

a tube to connect the compressed air generator and the nozzle, through which the compressed air passes;

a cooling device to cool at least a portion of the tube;

a drain discharging portion to discharge drain fluid generated in the tube during cooling by the cooling device; and a humidity detector to detect humidity of the image forming apparatus and activate the cooling device when the humidity exceeds a maximum permissible humidity.

3. The image forming apparatus according to claim 1 further comprising a temperature detector to detect ambient temperature and activate the cooling device when the ambient temperature is greater than or equal to a predetermined temperature.

4. The image forming apparatus according to claim 3, wherein the temperature detector detects temperature of the tube and activates the cooling device when the temperature of the tube exceeds a maximum permissible temperature.

5. An image forming apparatus, comprising:

a compressed air generator to generate and inject compressed air onto at least one of a recording medium and components in the image forming apparatus;

a nozzle from which the compressed air is injected;

a tube to connect the compressed air generator and the nozzle, through which the compressed air passes;

a cooling device to cool at least a portion of the tube;

a drain discharging portion to discharge drain fluid generated in the tube during cooling by the cooling device, wherein the cooling device is activated when an operation time of the image forming apparatus exceeds a maximum permissible time.

6. An image forming apparatus, comprising:

a compressed air generator to generate and inject compressed air onto at least one of a recording medium and components in the image forming apparatus;

a nozzle from which the compressed air is injected, a tube to connect the compressed air generator and the nozzle, through which the compressed air passes;

a cooling device to cool at least a portion of the tube; and a drain discharging portion to discharge drain fluid generated in the tube during cooling by the cooling device, wherein the cooling device is a fan that blows air against the tube.

7. The image forming apparatus according to claim 1, wherein the cooling device is a Peltier cooling device that directly contacts the tube.

8. An image forming apparatus, comprising:

a compressed air generator to generate and inject compressed air onto at least one of a recording medium and components in the image forming apparatus;

a nozzle from which the compressed air is injected;

a tube to connect the compressed air generator and the nozzle, through which the compressed air passes;

a cooling device to cool at least a portion of the tube; and a drain discharging portion to discharge drain fluid generated in the tube during cooling by the cooling device, wherein the cooling device cools the tube between the compressed air generator and the drain discharging portion.

9. An image forming apparatus, comprising:

a compressed air generator to generate and inject compressed air onto at least one of a recording medium and components in the image forming apparatus;

a nozzle from which the compressed air is injected;

a tube to connect the compressed air generator and the nozzle, through which the compressed air passes;

a cooling device to cool at least a portion of the tube;

a drain discharging portion to discharge drain fluid generated in the tube during cooling by the cooling device; and an air tank to adjust fluctuation of pressure of the compressed air in the tube between the compressed air generator and the nozzle, wherein the cooling device cools the air tank.

10. The image forming apparatus according to claim 1, wherein the cooling device is activated when an estimated drain fluid amount is greater than at least a first drain fluid amount.

11. The image forming apparatus according to claim 10, wherein the cooling device comprises a first cooling device and a second cooling device, the first cooling device is activated when the estimated fluid amount is greater than the first drain fluid amount, and the second cooling device is activated when the estimated fluid amount is greater than one of the first drain fluid amount and a second drain fluid amount that is different from the first drain fluid amount.

12. The image forming apparatus according to claim 11, further comprising:

an air tank connected to the compressed air generator and to the nozzle downstream of the portion of the tube cooled by the cooling device, wherein the portion of the tube cooled by the cooling device is cooled by the first cooling device and the air tank is cooled by the second cooling device.

13. The image forming apparatus according to claim 10, further comprising:

a temperature detector to detect a temperature of the image forming apparatus;

a humidity detector to detect a humidity of the image forming apparatus, wherein the estimated drain fluid amount is determined based on at least one of the temperature and the humidity of the image forming apparatus.

14. The image forming apparatus according to claim 1, further comprising:

an air tank connected to the compressed air generator and to the nozzle downstream of the portion of the tube cooled by the cooling device, wherein the air tank includes a drain port that is connected to drain discharging portion and the drain discharging portion discharges the drain fluid from the tube and the air tank.

* * * * *